United States Patent [19]

Green

[11] 4,144,621

[45] Mar. 20, 1979

[54] ADJUSTABLE RESILIENT EYELET CLAMP FOR SHOES

[76] Inventor: Robert L. Green, 2744 N. 60th St., Scottsdale, Ariz. 85257

[21] Appl. No.: 904,572

[22] Filed: May 10, 1978

[51] Int. Cl.[2] ..... A44B 21/00; B44D 3/18

[52] U.S. Cl. ..... 24/73 ES; 24/73 HH; 24/73 A; 24/143 A; 24/72.7; 24/201 A; 403/213

[58] Field of Search ..... 24/143 A, 143 R, 143 B, 24/73 HH, 72.7, 265 EE, 265 R, 73 JH, 73 R, 73 ES, 73 GC; 403/213

[56] References Cited

U.S. PATENT DOCUMENTS

| | | | |
|---|---|---|---|
| 671,712 | 4/1901 | Soderberg | 24/143 R |
| 680,249 | 8/1901 | Heinitsh | 24/143 R |
| 1,970,152 | 8/1934 | Stangler | 24/143 R |
| 3,917,387 | 11/1975 | Ensing | 24/73 HH |

FOREIGN PATENT DOCUMENTS

| | | | |
|---|---|---|---|
| 664934 | 9/1929 | France | 24/143 R |

*Primary Examiner*—Bernard A. Gelak
*Attorney, Agent, or Firm*—Warren F. B. Lindsley

[57] ABSTRACT

A resilient securing, fastening or gripping means for the eyelets of shoes for men, women and children replacing the ordinary shoe laces and which is adjustable to fit any shoe.

6 Claims, 11 Drawing Figures

ADJUSTABLE RESILIENT EYELET CLAMP FOR SHOES

BACKGROUND OF THE INVENTION

This invention relates to resilient securing, fastening or gripping means which is adjustable to fit between the eyelets of men's, women's and children's shoes to replace the ordinary shoe laces.

DESCRIPTION OF THE PRIOR ART

Although the prior art has disclosed resilient fastening means for use between eyelets of a shoe thereby replacing the ordinary shoe laces, none of the known art have disclosed a resilient gripping means that is adjustable at the time of installation by the wearer to fit his particular shoes whether man, woman or child, and also fit to his or her satisfaction the particular pair of eyelets in question. It should be realized that the span between each pair of eyelets may be and probably is different even on the same shoe.

U.S. Pat. No. 562,114 discloses a shoe fastening which embodies two pre-bent hooks interconnected by an elastic band.

U.S. Pat. No. 794,128 discloses an elastic lace or cord having metallic catches at opposite ends employing tubular clamps in which the ends of the cord are inserted.

U.S. Pat. No. 1,966,135 discloses a resilient grip member for shoes having a disk at each end of the grip member adapted to rest against the material around the eyelet in the shoe.

U.S. Pat. No. 2,289,225 discloses an elastic strand having integral ball heads on the ends of the strands and a bendable hook projecting from one of the heads and engageable in an eyelet in a shoe.

U.S. Pat. No. 3,701,572 discloses a stretchable shoe string.

SUMMARY OF THE INVENTION

In accordance with the invention claimed, an improved resilient or elastic shoe fastener or grip is disclosed which can be selectively adjusted to fit comfortably any pair of eyelets in any men's, women's or child's shoe at the option of the user.

It is, therefore, one object of this invention to provide an improved resilient shoe fastening means which is adjustable by the user to fit any particular pair of eyelets of his shoe.

Another object of this invention is to provide an improved resilient shoe fastening means for spanning the gap between a given pair of eyelets which together with other similar fastening means when individually fitted to extend between other pairs of eyelets of that shoe replace the ordinary shoe lace.

A further object of this invention is to provide an improved ornamental shoe fastening means which when properly fitted between given pairs of eyelets conceal the adjustable gripping means arranged at the ends of the resilient spanning member.

A still further object of this invention is to provide an improved ornamental shoe fastening means which may be easily adjusted for a particular pair of eyelets by the handicapped user as well as others so that he or she may use any conventional style shoe other than a slip on. The fastening means may be easily inserted and may stay indefinitely between a pair of eyelets or may be quickly removed or replaced, if so desired.

A still further object of this invention is to provide a durable, inexpensive and still attractive resilient shoe fastening which may be manufactured in various colors to fit any color shoe.

These and other objects and advantages of this invention will become more apparent as the description is given and the features of novelty which characterize this invention will be pointed out with particularity in the claims annexed to and forming a pair of this specification.

BRIEF DESCRIPTION OF THE DRAWING

The present invention may be more readily described by reference to the accompanying drawing of which.

DESCRIPTION OF THE PREFERRED EMBODIMENT

Figure 1:
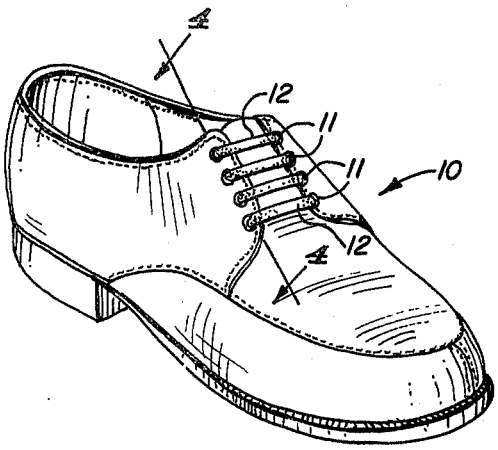
FIG. 1 is a perspective view of a shoe showing a plurality of the disclosed fastening means extending between given sets of eyelets and embodying the invention.

Referring more particularly to the drawing by characters of reference, FIG. 1 discloses a conventional shoe 10 which is representative of any style for man, woman or child.

The shoe is provided with the usual pair of the normal lace receiving eyelets 11.

In accordance with the teachings of this invention, an improved clamping, gripping or fastening means 12 is provided to extend between any pair of eyelets 11 whether in the manner shown on the shoe of FIG. 1 or any other combination of given pairs of eyelets in the shoe.

Each fastening means comprises a resilient member 13 extending substantially the full length of the fastening means formed out of any suitable material which will be elastic enough to firmly hold its position when adjusted to fit between a given set of eyelets but comfortable when the wearer of the shoe bends or twists his foot. This resilient member may be formed of material which is precolored in a range of colors to match the color of the shoe or form a pleasing color combination with it.

Figure 4:
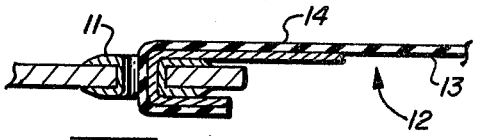
FIG. 4 is a cross-sectional view of FIG. 1 taken along the line 4—4.

FIGS. 1 and 4 illustrate that the fastening means are provided with metal ends 14 which are bonded in some suitable way such as by gluing or vulcanizing to the ends of the resilient member 13. The thickness of the metallic ends of the fastening means may be one half or less than the thickness of the associated resilient member bonded thereto.

In this instance, the ends of the fastening means may be bent at any suitable place along each end in the same direction to form a U-shaped hook as shown in FIG. 4. The bend is made so as to pass through the eyelet with the end of the fastening means lying closely adjacent the flap of the shoe with the end of the bend facing its associated eyelet.

Figure 3:
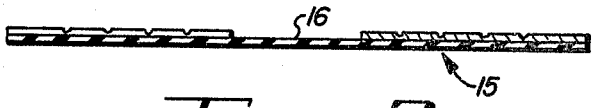
FIG. 3 is a cross-sectional view of FIG. 2A taken along the line 3—3.
Figure 2A:
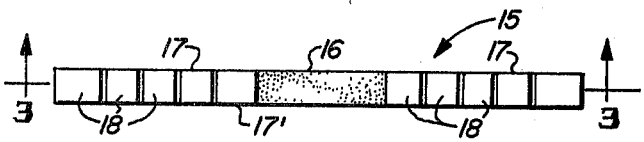
FIG. 2A is an enlarged plan view of the bottom of a modification of the fastening means shown in FIG. 1.
Figure 2B:
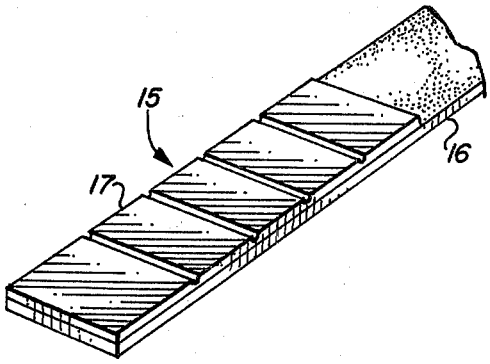
FIG. 2B is an enlarged perspective view of one end of the fastening means shown in FIG. 2A.

FIGS. 2A, 2B and 3 illustrate that metal ends 17 of clamp 15 may be scored or otherwise marked laterally at a number of points along its length to form a number of parts or sections 18 with each score line serving as a bend line for that end of the clamp or fastening means. Thus, as shown in these figures, the resilient member 16 and its end 17 may be easily adjusted to fit any number of different size shoes as well as different pairs of eyelets and if the selected bend line is not satisfactory, it may be modified by bending it at another selected bend line.

Figure 5A:
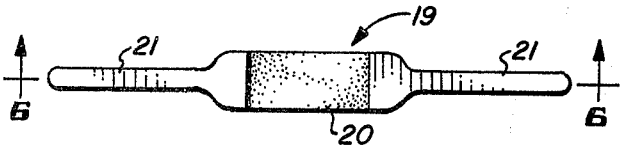
FIG. 5A is a plan view of a modification of the shoe fastening means shown in FIGS. 1-4.
Figure 6:
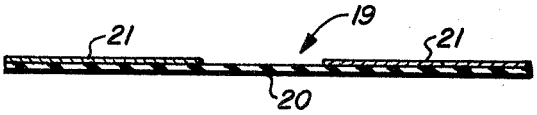
FIG. 6 is a cross-sectional view of FIG. 5A taken along the line 6—6.
Figure 5B:
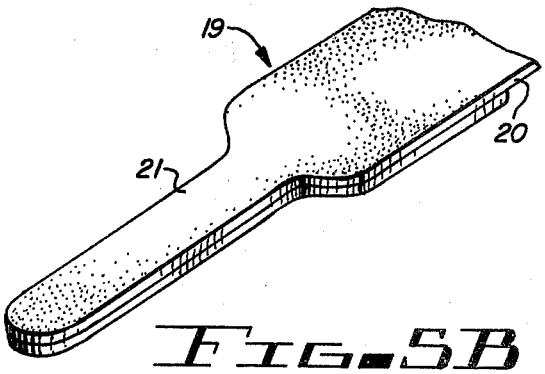
FIG. 5B is an enlarged perspective view of one end of the fastening means shown in FIG. 5A.

FIGS. 5A, 5B and 6 illustrate a further fastening means 19 comprising a resilient member 20 having a metallic end 21 at each end bonded in a suitable manner to the resilient base 20. It should be noted in this particular illustration that the ends are necked down to form narrow ends which will accommodate associated eyelets of a shoe on which it is to be used.

Figure 7:
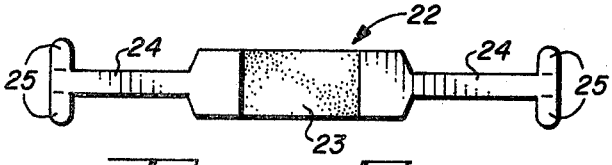
FIG. 7 is a plan view of a further modification of the shoe fastening means shown in FIGS. 1-6.
Figure 8:
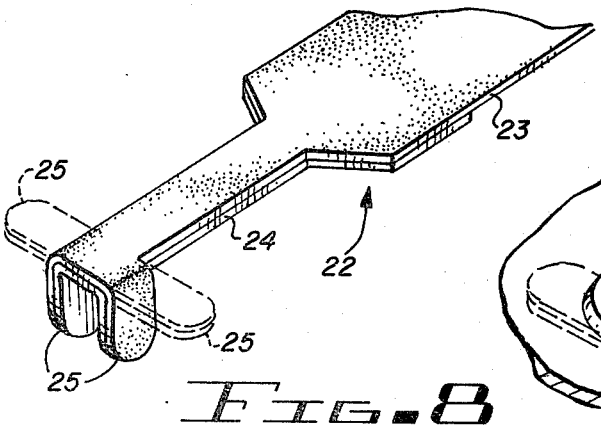
FIG. 8 is an enlarged perspective view of one end of the shoe fastening means shown in FIG. 7.
Figure 9:
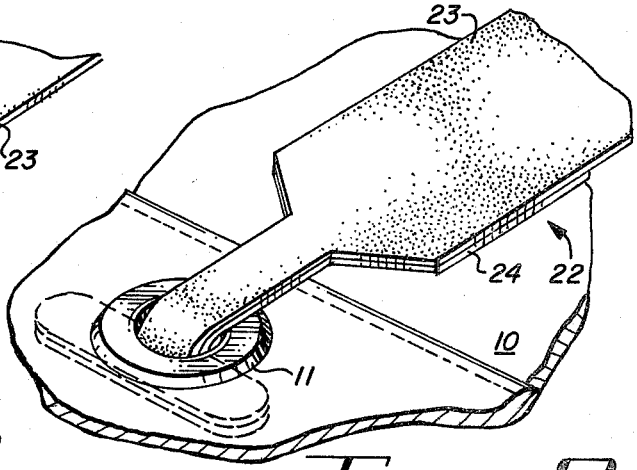
FIG. 9 is an enlarged perspective view of the shoe fastening means shown in FIGS. 7 and 8 in engagement with one eyelet of a shoe.

FIG. 7 illustrates a further modification of the invention wherein a fastening means 22 is disclosed comprising a resilient base 23 having a metallic member or surface 24 arranged at each end. In this instance, a tab 25 is arranged at each end of the fastening means which together with the resilient base member 23 is bent to form a U-shaped clamp having the ends of the tabs being bendable at substantially 90° as shown in the full line illustration shown in FIG. 8 so that it may easily pass through the eyelets of a shoe and then bent back to its position shown in FIGS. 7 and 9 to firmly attach to the material of the shoe.

Although but a few embodiments of the present invention have been illustrated and described, it will be apparent to those skilled in the art that various changes and modifications may be made therein without departing from the spirit of the invention or from the scope of the appended claims.

What is claimed is:

1. A shoe fastener for extending between cooperating pairs of eyelets comprising:

a flat resilient member, and a pair of flat metallic members one bonded to cover substantially the width of a common surface of said resilient member at each end thereof, said metallic members being selectively bendable at points laterally of its end to form a hook for engaging in an eyelet of a shoe, said resilient member extending along substantially the full length of said metallic members.

2. The shoe fastener set forth in claim 1 wherein:

at least one of said metallic members is scored or marked laterally of its length to form bend lines at which point the hook is formed for engaging the eyelets of the shoe.

3. The shoe fastener set forth in claim 1 wherein:

each metalic member is scored or marked laterally of its length to form bend lines at a number of points along their length at which the metallic member and that end of the resilient member may be bent back on itself to form a hook.

4. The shoe fastener set forth in claim 1 wherein:

the metallic member at each end of the fastening means is necked down to a width which will accommodate an associated eyelet of a shoe on which it is used.

5. The shoe fastener set forth in claim 4 wherein:

the free ends of each metallic member and the associated end of said resilient member is provided with a tab extending laterally of the length of said metallic member which tab ends are bent to form a U-shaped extending at substantially at 90° angle from the end of said metallic member, whereby the tab ends may be passed through an eyelet of a shoe and then bent back to their initial position to rest against the material of the shoe around the respective eyelet.

6. The shoe fastener set forth in claim 1 wherein:

the thickness of the metallic members are substantially one half or less than the thickness of the associated resilient member.

* * * * *

UNITED STATES PATENT OFFICE

CERTIFICATE OF CORRECTION

Patent No. 4,144,621 Dated March 20, 1979

Inventor(s) Robert L. Green

It is certified that error appears in the above-identified patent and that said Letters Patent are hereby corrected as shown below:

Claim 5, line 6, cancel "shaped extending at substantially at 90° angle from" and substitute ---shape extending at substantially a 90° angle from---.

Signed and Sealed this

*Twenty-ninth* Day of *May 1979*

[SEAL]

*Attest:*

RUTH C. MASON
*Attesting Officer*

DONALD W. BANNER
*Commissioner of Patents and Trademarks*